US005890877A

United States Patent [19]

Peterson et al.

[11] Patent Number: 5,890,877

[45] Date of Patent: Apr. 6, 1999

[54] CAVITATION CONTROL FOR SWASH-PLATE HYDRAULIC PUMPS

[75] Inventors: Walter G. Peterson, Travelers Rest; Gary P. Pittman, Spartanburg, both of S.C.

[73] Assignee: Dana Corporation, Toledo, Ohio

[21] Appl. No.: 774,691

[22] Filed: Dec. 26, 1996

[51] Int. Cl.[6] ..... F04B 1/26

[52] U.S. Cl. ..... 417/222.1; 417/213; 417/270

[58] Field of Search ..... 417/222.1, 213, 417/270

[56] References Cited

U.S. PATENT DOCUMENTS

| | | | |
|---|---|---|---|
| 2,502,546 | 4/1950 | Adams . | |
| 3,946,562 | 3/1976 | Ross | 60/464 |
| 4,102,607 | 7/1978 | Benson | 417/222 |
| 5,064,351 | 11/1991 | Hamey et al. | 417/222 R |
| 5,066,201 | 11/1991 | Nagai et al. | 417/222 |
| 5,108,267 | 4/1992 | Horst | 417/218 |
| 5,187,933 | 2/1993 | Nikolaus . | |
| 5,207,751 | 5/1993 | Suzuki et al. | 417/222.1 |
| 5,222,870 | 6/1993 | Budzich | 417/222.1 |
| 5,249,935 | 10/1993 | Burgdorf . | |
| 5,273,403 | 12/1993 | Im et al. | 417/213 |
| 5,285,641 | 2/1994 | Goto et al. | 60/422 |
| 5,344,288 | 9/1994 | Oda . | |
| 5,443,587 | 8/1995 | Takizawa | 417/222.1 |
| 5,588,805 | 12/1996 | Geringer | 417/53 |
| 5,653,189 | 8/1997 | Payne | 114/274 |
| 5,725,360 | 3/1998 | Matsumoto et al. | 417/218 |

*Primary Examiner*—Timothy S. Thorpe
*Assistant Examiner*—Ehud Gartenberg
*Attorney, Agent, or Firm*—Millen, White, Zelano & Branigan, P.C.

[57] ABSTRACT

Cavitation in a swash-plate pump is prevented by applying pump input pressure and a preselected spring force to a first end of a valve spool against countervailing atmospheric pressure applied against a second end of the valve spool wherein the valve spool moves to an open position with respect to an anti-cavitation valve upon the sum of the input pressure and spring pressure decreasing to less than atmospheric pressure. When the anti-cavitation valve opens, pump output pressure is applied through the anti-cavitation valve to a pump displacement control cylinder which decreases pump displacement so as to keep pump input pressure from decreasing to the point of cavitation.

14 Claims, 2 Drawing Sheets

CAVITATION CONTROL FOR SWASH-PLATE HYDRAULIC PUMPS

FIELD OF THE INVENTION

The present invention is directed to cavitation control for variable displacement hydraulic pumps and, more particularly, the present invention is directed to cavitation control for variable displacement hydraulic pumps in which displacement is decreased in order to avoid cavitation.

BACKGROUND OF THE INVENTION

Variable displacement hydraulic pumps include a number of controls for protecting pumping systems and pump components and for reducing wasted pump power during operation. For example, pressure compensator controls reduce displacement when outlet pressure becomes too high and load sense controls make adjustments to change in load pressure to improve efficiency.

An additional problem which presents difficulties to variable displacement hydraulic pumps is cavitation which can destroy a variable displacement pump or severely limit its life. Cavitation generally occurs when the fluid supply pressure on the inlet or suction side of a variable displacement pump is too low (high vacuum). The hydraulic fluid vaporizes in a vacuum which results in gas bubbles in the oil. The bubbles are carried through the pump and collapse with considerable force when exposed to the load pressures at the outlet. In addition to adversely affecting the pump itself, gas bubbles can damage the consuming device receiving hydraulic fluid from the pump.

One approach to this problem is to avoid cavitation by increasing the flow of input fluid upon cavitation being detected so that air is not drawn into the pump and system. With this approach, the pump tends to exceed its designed capacity upon experiencing cavitation. It is, of course, not prudent to exceed the design capacity of a device and it is usually not economically desirable to over design a device so as to accommodate cavitation, if such over design can be avoided. In any event, there are difficulties with such an approach.

The low inlet pressure and resulting vacuum which creates cavitation, can be due to a number of conditions such as restricted inlet area, high viscosity oil, a clogged inlet filter or a clogged strainer. At least with respect to variable displacement pumps in which the pistons move in an axial direction, no attempt has been made to prevent cavitation by decreasing displacement. By so doing, the risk of operating a pump at over capacity, or the disadvantages, both economic and technical, of overdesigning pumps can be avoided.

SUMMARY OF THE INVENTION

It is a feature of the present invention to provide a new and improved system for controlling cavitation in variable displacement pumps by reducing displacement upon sensing low inlet pressure.

With this in mind, the present invention is directed to a hydraulic control system for a variable displacement pump having an input and outlet wherein the system comprises a displacement control connected to the pump for varying the displacement thereof and a valve for directing pump output pressure to the displacement control in order to reduce pump displacement and inlet pressure.

In a more specific aspect of the invention, pump inlet pressure is sensed and that pressure is added to a spring pressure which is compared to the force of atmospheric pressure. When atmospheric pressure exceeds the combination of inlet pressure and spring pressure, the piston shifts allowing pump outlet pressure through to the displacement control which then decreases pump displacement.

In a more specific aspect of the invention, pump inlet pressure is sensed and that pressure is added to a spring pressure which is compared to the force of atmospheric pressure. When atmospheric pressure exceeds the combination of inlet pressure and spring pressure, the piston shifts allowing pump outlet pressure through the displacement control which then decreases pump displacement.

In still a more specific aspect of the invention, the aforedescribed features are incorporated in a cavitation control valve which is connected in series through a pressure compensator control valve and a load sense control valve to the displacement control. The displacement control includes a control piston which is advanced against the force of a spring which normally biases the control piston to a position for maximum displacement of the variable displacement pump. The pressure compensation valve and load sense valve are operated by pump output pressure, whereas the anti-cavitation valve is operated by a comparison of pump input pressure to atmospheric pressure.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
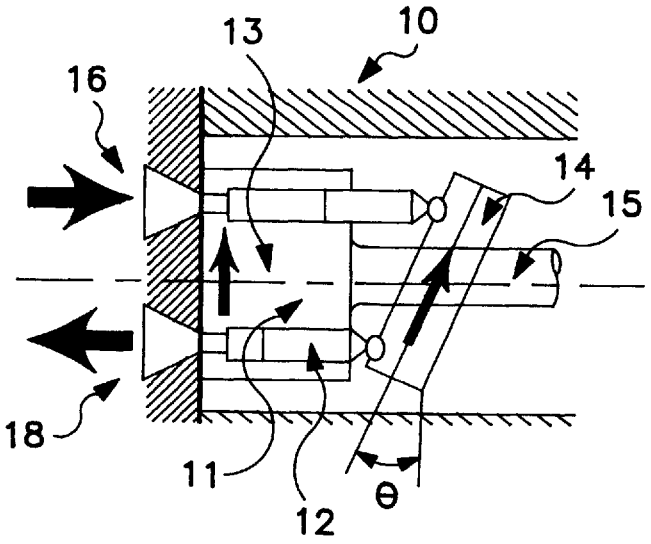
FIG. 1 is a side elevation of an axial piston pump of the general type utilizing principles of the present invention.

Referring now to FIG. 1, there is shown an axial piston pump 10 including a plurality of axial displacement pistons 12 reciprocating from the angle of the swashplate 14 in the direction of parallel axis 13 rotating around in a cylinder barrel 11 which is driven by a driveshaft 15 to pump hydraulic fluid from an input 16 to an output 18. Displacement of the pump 10 is controlled by the angle θ of the swashplate 14 perpendicular with respect to axis 13. When the swashplate 14 is at a relatively large angle with respect to the axis 13 of the axially oriented pistons 12, the pump 10 is at its maximum displacement. When the angle θ is equal to zero so that the swashplate 14 is perpendicular to the axis 13 and the pistons 12, then the displacement is zero.

Figure 2:
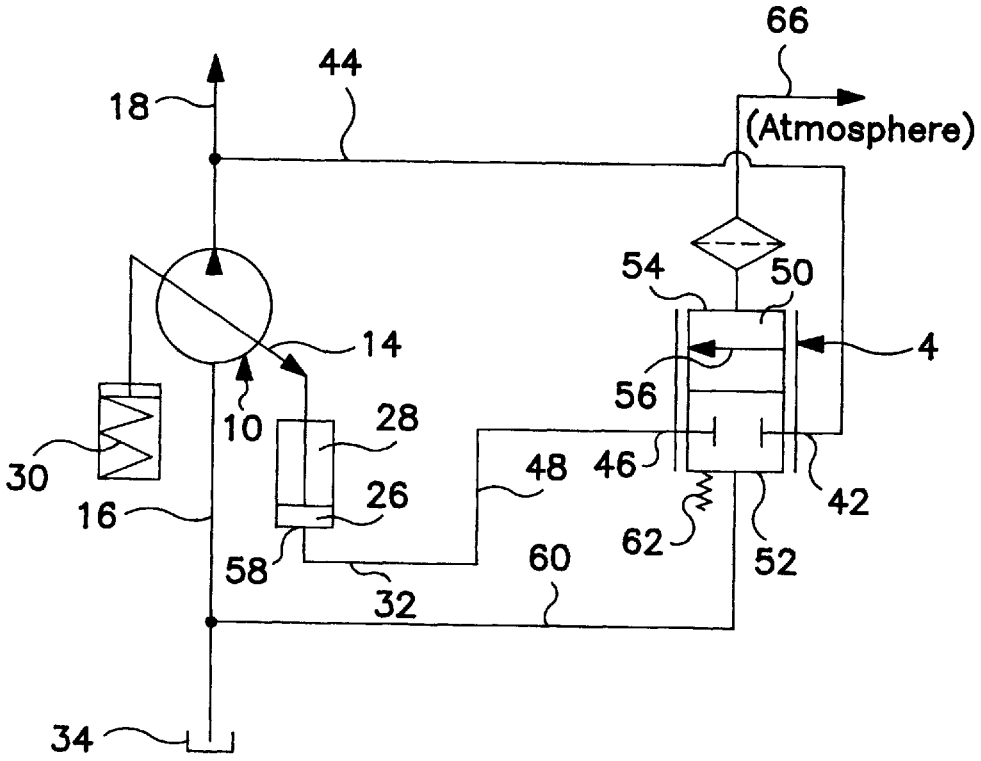
FIG. 2 is a schematic diagram of a hydraulic circuit including schematically variable displacement pump of FIG. 1.

Referring now to FIG. 2, the angle θ of the swashplate 14, perpendicular with respect to axis 13, is controlled by a displacement control piston 26 mounted in a displacement control cylinder 28. Generally, the piston 26 acts against a spring 30 which biases the piston to hold the swashplate 14 to its maximum displacement. By applying hydraulic pressure over a line 32 to the face of the piston 26 in opposition to the spring 30, the angle of the swashplate 14 is reduced perpendicular to the axis 13 so that the displacement of the pump is zero.

Generally, the input line 16 of the variable displacement pump 10 is connected to a reservoir 34 or tank of hydraulic fluid and the output 18 is connected to a consumer (not shown) of the hydraulic power generated by the pump which is the load on the pump. For example, the consumer can be a hydraulic cylinder which might move any number of things such as, for example, a hydraulic lift or a blade of a bulldozer.

In accordance with the present invention, a cavitation control valve 40 has an inlet 42 which is connected by a line 44 to the pump output line 18 and has an outlet 46 which is connected by a line 48 to an inlet 58 of the displacement control cylinder 28. When the valve 40 is closed, hydraulic fluid cannot flow therethrough to the displacement control cylinder 28 but, when the valve 40 is opened, hydraulic fluid does flow therethrough to cause the hydraulic displacement cylinder 28 to reduce the displacement of the pump 10 by decreasing the angle θ between the swash-plate 14 and a line perpendicular to the axis 13 and the axial pistons 12 in the variable displacement pump 10 (see FIG. 1).

The valve 40 includes valve spool 50 which has a first face 52 and a second face 54. When the valve spool 50 is in the FIG. 2 position, a passage 56 therethrough is not aligned with the inlet 42 and outlet 46 but, when the spool 50 is shifted downwardly with respect to FIG. 2 to align the passage 56 with the inlet 42 and outlet 46, hydraulic pressure from the line 44 is applied through to the line 48 to the hydraulic cylinder 28 to move piston 26 against the bias of the spring 30.

Shifting the valve 40 from the closed mode to the open mode is accomplished by a "comparator system" comprising an input pressure line 60 connected to the pump inlet line 16 to provide inlet pressure which is applied to the first end 52 of the spool 50, as well as a spring 62 which applies a preselected force having a pressure of 0–6 psi to the first end 52 of the spool 50. The force of the spring 62 and the force due to the inlet pressure on line 60 is opposed by atmospheric pressure applied via a line 66 to the second end 54 of the spool 50. In accordance with the present invention, when the force of atmospheric pressure from line 66 on the second end 54 of the spool 50 exceeds the force applied to the first end 52 of the spool 50 by the spring 62 and input pressure 60, the spool shifts to the open position so that the hydraulic fluid flows into the inlet 42, passes through the passage 56 and then out of the outlet 46. As stated before, the fluid from the outlet 46 flows through line 48 to move piston 26 to decrease displacement in the pump 10 so that the pressure at the inlet 16 to the pump 10 does not decrease to the point of cavitation.

Figure 3:
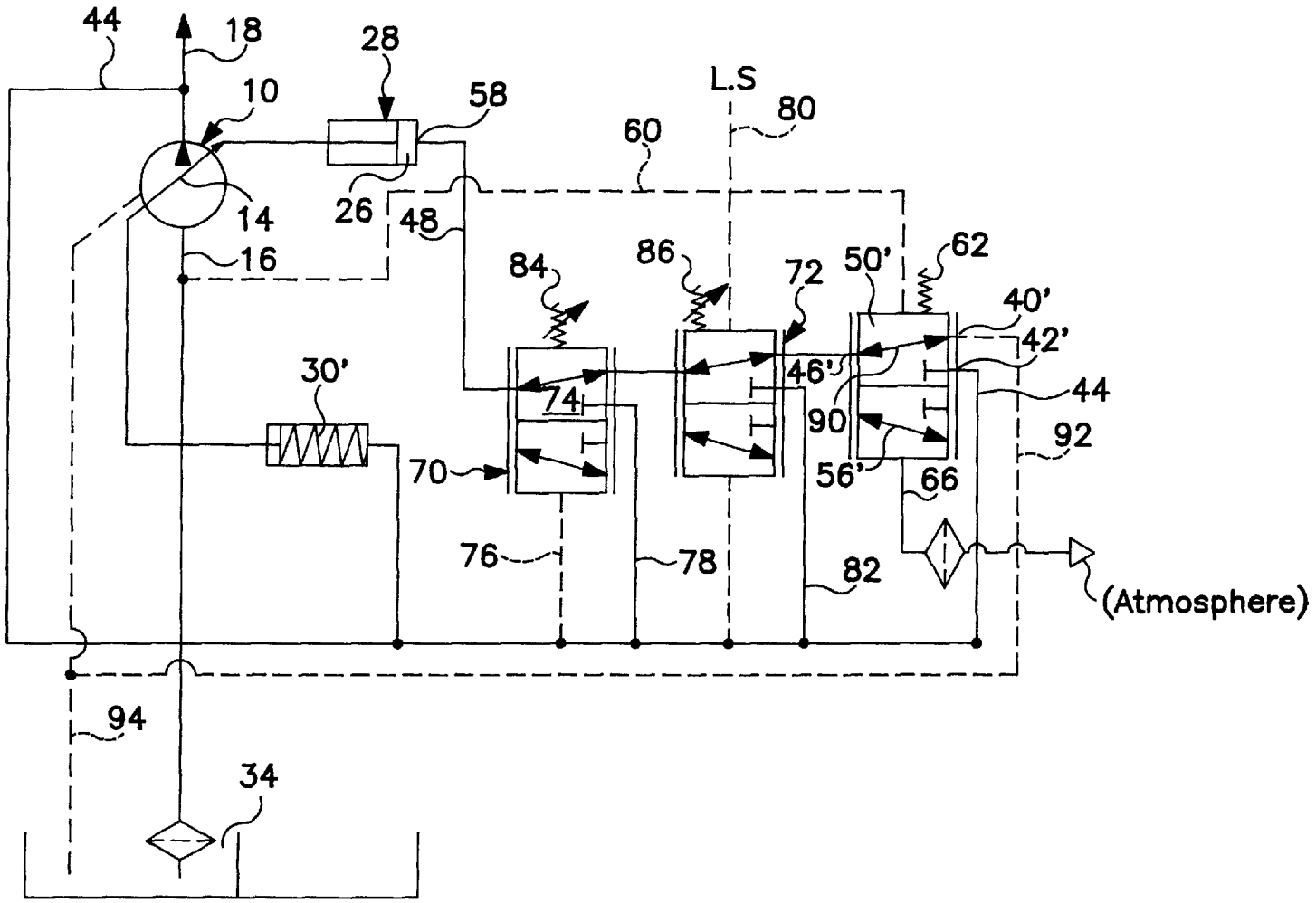
FIG. 3 is a schematic diagram of a hydraulic circuit schematically including the variable displacement pump of FIG. 1 and further including a pressure compensator valve and a load sense control valve.

Referring now to FIG. 3 where similar structures have similar reference numerals, although the structures may be oriented differently in the drawing, the concept of FIG. 2 is shown in conjunction with a control system which includes a pressure compensator valve 70 and a load sense control valve 72. The pressure compensator control valve 70 has a spool 74 which is biased by output pressure on line 76 to prevent application of output pressure on line 78 to the displacement control cylinder 28, while allowing application of output pressure from the anti-cavitation control valve 40' to pass therethrough to the control cylinder. The same arrangement exists with the load sense control valve 72, wherein when the variable displacement pump 10 is applying output pressure to line 44 and the load sensed pressure over line 80 is not excessive, output pressure on line 82 is not transmitted through the load sense control valve 72. But if the anti-cavitation valve 40' is opened, the load sense control valve 72 will allow output pressure on the line 44 to pass through to the displacement control cylinder 28. The sensitivity of the pressure compensator control valve 70 is adjusted by an adjustable spring bias 84 and the sensitivity of the load sense control valve 72 is controlled by an adjustable spring bias 86.

When the spool 50' of the anti-cavitation valve 40' is in the closed position shown in FIG. 3, a passage 90 through the spool 50' connects the line 48 from the displacement control cylinder 28 through to an exhaust line 92 which drains to tank 34 via drain 94 which is also connected to drain the variable displacement pump 10. Upon atmospheric pressure on line 66 overcoming the force of the spring 62 plus the force of the intake pressure on line 60, the spool 50' shifts so that the passage 56' connects inlet 42' to outlet 46' which transmits the pressure on output line 44 through to the piston 26 in the hydraulic cylinder 28 via the pressure compensator valve 70 and load sense control valve 72. Again, pressure on the piston 26, sufficient to move it against the spring 30, reduces displacement of the pump 10 so that pressure at the inlet 16 does not decrease to the point of cavitation.

In summary, the axial piston variable displacement pump 10 shown in FIG. 1, has the angle θ of the swashplate 14 adjusted to decrease displacement when atmospheric pressure exceeds the combination of spring pressure and pump intake pressure so that pressure at the inlet 16 of the pump does not decrease to the point of cavitation.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A hydraulic control system for a variable displacement pump having an input and output, comprising:

a displacement control connected to the pump for controlling a displacement of the pump;

a comparator for comparing pump input pressure to atmospheric pressure;

a valve for connecting pump output pressure to the displacement control for decreasing the displacement of the variable displacement pump upon applying the pump output pressure thereto; and an arrangement interconnecting the comparator and valve for opening the valve to apply the output pressure to the displacement control upon the atmospheric pressure exceeding the pump input pressure by a preselected amount.

2. The hydraulic control system of claim 1, wherein the comparator includes a spring for applying a force having a pressure which is cumulative with pump input pressure.

3. The hydraulic control system of claim 2, wherein the pressure applied by the spring is in a range of about 0 to about 6 psi.

4. The hydraulic control system of claim 1, wherein the arrangement of interconnecting the comparator and the valve comprises a valve spool within the valve, the valve spool having a first end to which the pump input pressure and a pressure from a spring is applied and a second end to which atmospheric pressure is applied, the valve spool having a passage therethrough, and the spool cooperating with an inlet to which the pump output pressure is applied and an outlet connected to the displacement control.

5. The hydraulic control system of claim 4, wherein the pressure from the spring is in a range of about 0 to about 6 psi.

6. The hydraulic control system of claim 4, wherein the displacement control is a hydraulic cylinder with a piston therein, the piston being spring biased to a position in which pump displacement is maximized.

7. A hydraulic control system for a variable displacement pump having an input line from a sump and an output line to a consumer, the system comprising:

a control cylinder having a control piston for controlling a displacement of the pump, the control piston being biased to a position of maximum delivery of fluid from the pump to the output line;

a cavitation control valve having an inlet and an outlet and having a spool movable within the valve from a first position in which the spool closes passage from the inlet to the outlet to a second position in which the valve spool opens passage from the inlet to the outlet;

a spring biasing the valve spool to the first position to normally close the passage;

a first line connecting a first end of the valve to the input line of the pump for applying input line pressure to the spool to urge the spool to the first position in which the passage is closed;

an opening to the atmosphere at a second end of the valve for applying atmospheric pressure to the valve spool to urge the valve spool against the bias of the spring and input line pressure to the second position in which passage is open;

a line connecting the inlet of the cavitation control valve to the output line;

a line connecting the outlet of the captivation control valve to the input of the control cylinder for applying pressure to the control piston to decrease the displacement of the pump, and thus decrease an output of the pump;

whereby when atmospheric pressure exceeds a sum of the spring pressure and valve pressure, the cavitation control valve opens, decreasing pump displacement and a flow of hydraulic fluid to the pump input thereby preventing pressure at the pump input from decreasing to a point of captivation.

8. The system of claim 7, wherein the spring force applies a pressure in a range of about 0 to about 6 psi to the first end of the valve.

9. The system of claim 7 further including a pressure compensator valve and a load sense control valve in series between the outlet of cavitation control valve and an input of the control cylinder.

10. The system of claim 9, wherein the spring applies a force producing a pressure in a range of about 0 to about 6 psi to the first end of the valve.

11. The system of claim 10 further including an exhaust line to a tank normally connected to drain through the anti-cavitation valve when the passage is closed, the exhaust line being connected through the spool to the outlet of the anti-cavitation valve whereby fluid in the control cylinder exhausts through the anti-cavitation valve to tank.

12. The hydraulic control system of claim 11, wherein the pressure compensator valve and load sense valve are normally open with respect to the anti-cavitation valve and the control cylinder.

13. The hydraulic control system of claim 12, wherein the variable displacement pump is a swash plate compressor.

14. The hydraulic control system of claim 1, wherein the variable displacement pump is a swash plate compressor.

* * * * *